US006715651B2

(12) United States Patent
Le Gal

(10) Patent No.: US 6,715,651 B2
(45) Date of Patent: Apr. 6, 2004

(54) MODULAR CHILD CARRIER

(75) Inventor: Yann Le Gal, Voreppe (FR)

(73) Assignee: Lafuma S.A., Anneyron (FR)

( * ) Notice: Subject to any disclaimer, the term of this patent is extended or adjusted under 35 U.S.C. 154(b) by 6 days.

(21) Appl. No.: 10/094,843

(22) Filed: Mar. 11, 2002

(65) Prior Publication Data

US 2002/0130148 A1 Sep. 19, 2002

(30) Foreign Application Priority Data

Mar. 13, 2001 (FR) ..... 01 03647

(51) Int. Cl.[7] ..... A61G 1/00; A45F 3/04
(52) U.S. Cl. ..... 224/160; 224/646
(58) Field of Search ..... 224/158–168, 224/664; 297/467, 219.12, 485

(56) References Cited

U.S. PATENT DOCUMENTS 5,020,709 A * 6/1991 Hoaglan ..... 224/151
5,848,741 A * 12/1998 Fair ..... 224/160
5,868,292 A * 2/1999 Stephens et al. ..... 224/161
6,045,018 A * 4/2000 Onishi ..... 224/158
6,318,608 B1 * 11/2001 Fowler et al. ..... 224/161
6,415,969 B1 * 7/2002 Higuchi ..... 224/160

FOREIGN PATENT DOCUMENTS

EP 0 722 684 A1 7/1996
EP 0 734 671 A1 10/1996
FR 2404414 * 6/1979 ..... 224/160
GB 2215184 A * 9/1989 ..... 224/160

OTHER PUBLICATIONS

United States patent application Publication No. 2001/0030210 A1 to Donine, published Oct. 2001.*

* cited by examiner

*Primary Examiner*—Sue A. Weaver
(74) *Attorney, Agent, or Firm*—Heslin Rothenberg Farley & Mesiti P.C.

(57) ABSTRACT

A modular child carrier includes a back-mounted child carrier designed to accommodate internally a front-mounted child carrier. The two child carriers are connectable allowing either the front-mounted child carrier to be detached and used independently, or the front-mounted child carrier to be incorporated into the back-mounted child carrier so that a child of a very tender age can be carried. In one embodiment, the front-mounted child carrier is fitted on its front face with a cap having a plate and capable of being adjusted and positioned over an upper part of a front face of a framework of the back-mounted child carrier.

9 Claims, 6 Drawing Sheets

3c
3c1
2e
4
3a
10
2b
2c
e
2d
7-8
2a
3b
3
2
1

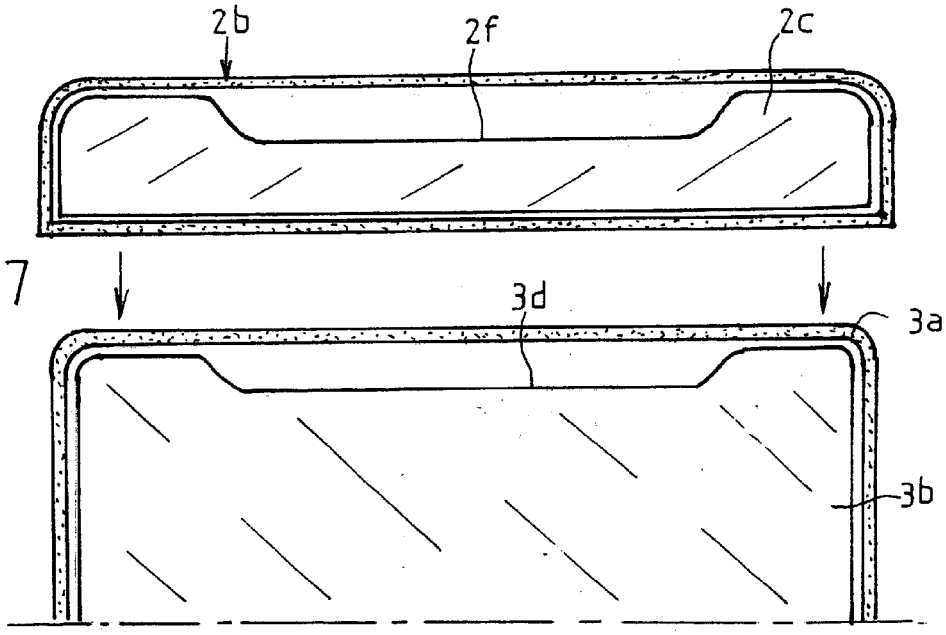
FIG.7
FIG.8
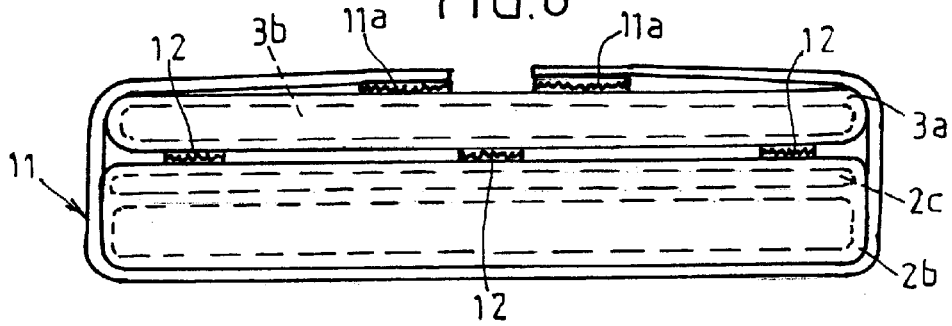

MODULAR CHILD CARRIER

This application claims the priority of French application FR 01.03647, filed Mar. 13, 2001.

The invention relates to the technical field of child carriers.

BACKGROUND OF THE INVENTION

The ideas of the back-mounted child carrier, and the front-mounted child carrier for carrying small children so that they face the wearer, are known from the prior art.

The front-mounted child carrier is used for children of a very tender age up to a weight of about 7 kilos. It allows the child to be carried facing the wearer for the first few weeks, then facing outward afterward. FIGS. 1 and 2 of the drawings in particular depict one embodiment and method of wearing. A securing harness is passed around the wearer, with a belt and straps connecting the baby carrier and the harness.

Back-mounted baby carriers are suitable for children only from the age of nine months up to about two years. They are built with a rigid load-bearing framework to which the rear side of the seat part and backrest of the child is attached, possibly with a protective and covering hood. The front side of the framework includes elements for passing around the waist of the wearer, shoulder straps for resting on the shoulders of the wearer and connecting and tensioning straps. Lateral strips connect the backrest part and the framework to avoid the child tipping from the seat part.

In addition, back-mounted child carriers may, within their interior volume, have a fixed retractable textile strip which can support the child in its first age range from about 9 to 12 months, at a different level than the bottom part of the bottom of the child carrier seat, which is designed to be used when the child is a little bigger up to the age of 2. Thus, said child carrier allows children of different sizes within the age range from 9 months to 2 years to be positioned very safely.

Thus, according to the prior art, there are two different products which exist, without there being any commonality or compatibility between them.

Hitherto, manufacturers have not conducted research or worked toward this goal.

What this then means is that users have to have two lots of equipment, with the associated costs.

The problem posed arises when users wish to go out on a walk or on an excursion, and there is then a choice to be made over which product to use. However, in practice, for this use, front-mounted child carriers are not particularly suitable and in use hamper the movements of the wearer.

SUMMARY OF THE INVENTION

The approach that the applicant has taken has therefore been to look into designing a child carrier which can meet the objective of offering the user a simple child carrier which more widely covers the age range from the first few weeks up to the age of two years.

The desired objective was to offer the user a child carrier which, through an original design, gave modular use both of a front-mounted baby carrier and of the back-mounted carrier, and for the abovementioned age range.

Another desired objective according to the invention was to offer a novel child carrier which was simple to use, easy to operate by adapting it according to the age of the child.

Another desired objective, according to the invention was to offer a child carrier which could be used independently in these variant versions depending on the age of the child.

According to a first feature of the invention, the child carrier is modular and consists of a back-mounted child carrier designed to accommodate internally a front-mounted child carrier, the two child carriers being arranged with linking and temporarily securing means allowing either the front-mounted child carrier to be detached and used independently, or it to be incorporated into the back-mounted child carrier so that a child of a very tender age can be carried.

According to another feature of the invention, the front-mounted child carrier is fitted on its front face with a cap shape having stiffening means and capable of being adjusted and positioned over the upper part of the front face of the framework of the back-mounted child carrier.

These features and others yet, will become clearly apparent from the remainder of the description.

BRIEF DESCRIPTION OF THE DRAWINGS

In order to pinpoint the object of the invention it is illustrated nonlimitingly in the figures of the drawings in which:

FIG. 7 is a view in cross section on the line B—B of FIG. 5, showing the connection and overlapping of the front part of the front-mounted child carrier on the front upper framework of the back-mounted child carrier.

FIG. 8 is a view of an alternative form of this connection.

DETAILED DESCRIPTION OF THE INVENTION

Figure 1:
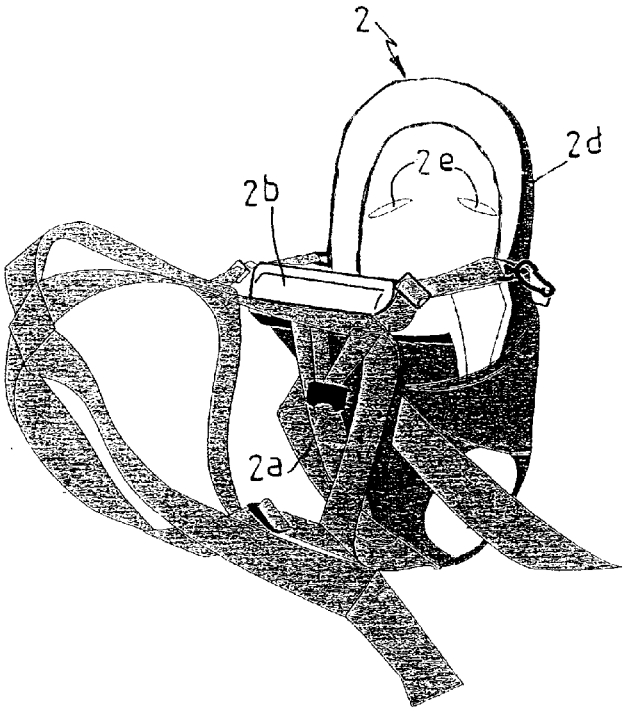
FIG. 1 is a three-quarters view of the front-mounted child carrier designed according to the invention.
Figure 2:
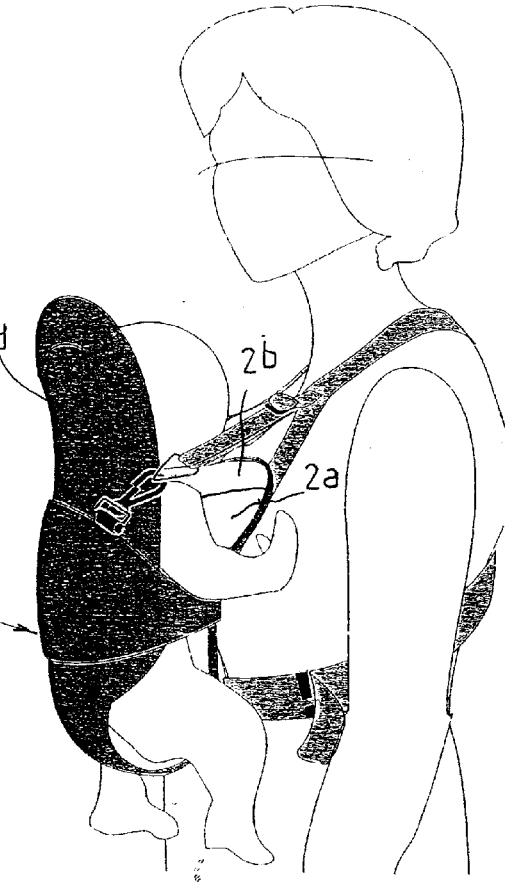
FIG. 2 is a side view illustrating the front-mounted child carrier in the situation of being worn independently.
Figure 3:
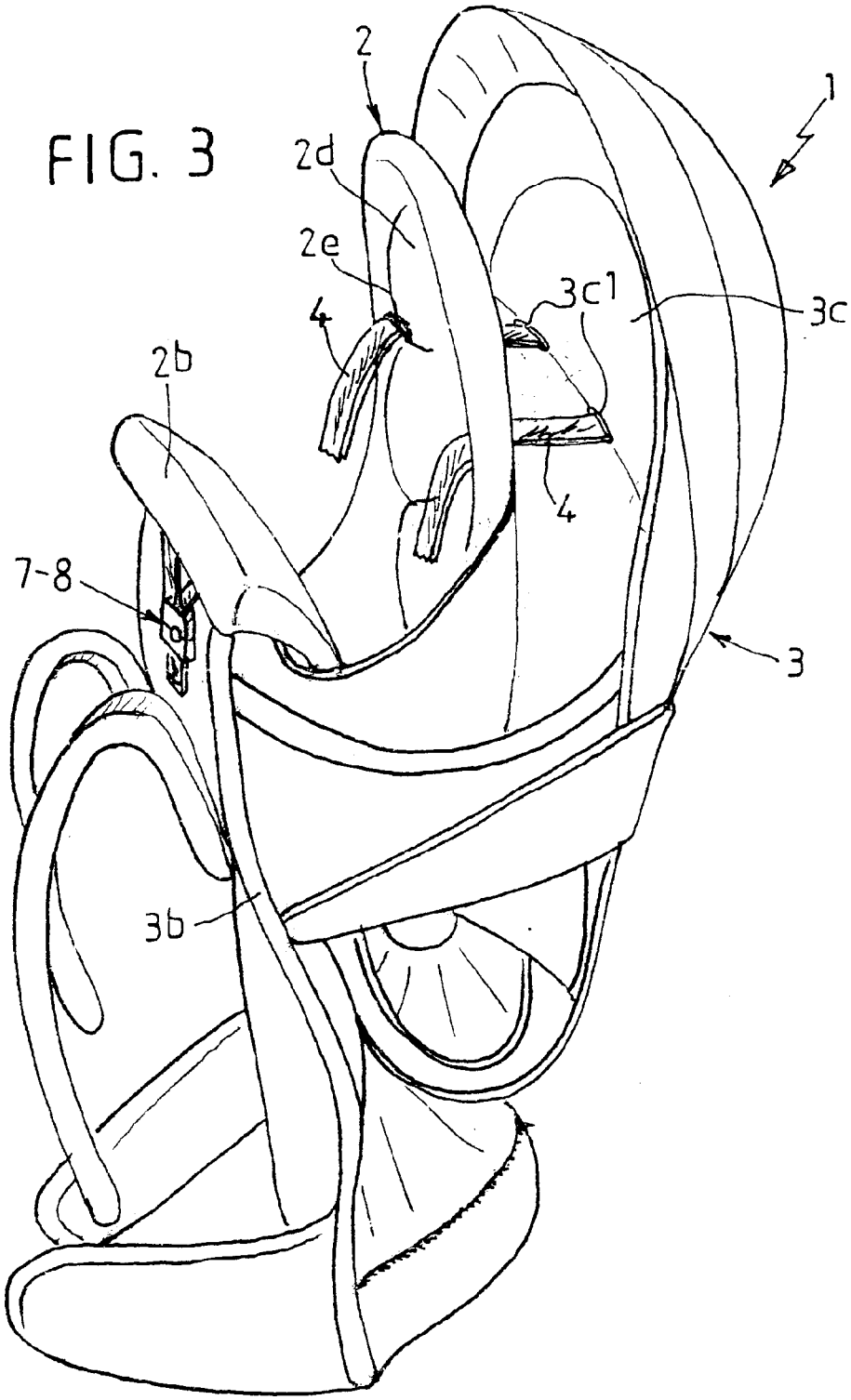
FIG. 3 is a perspective view of the modular child carrier including the arranging and positioning of the front-mounted child carrier in the structure of the back-mounted child carrier.
Figure 4:
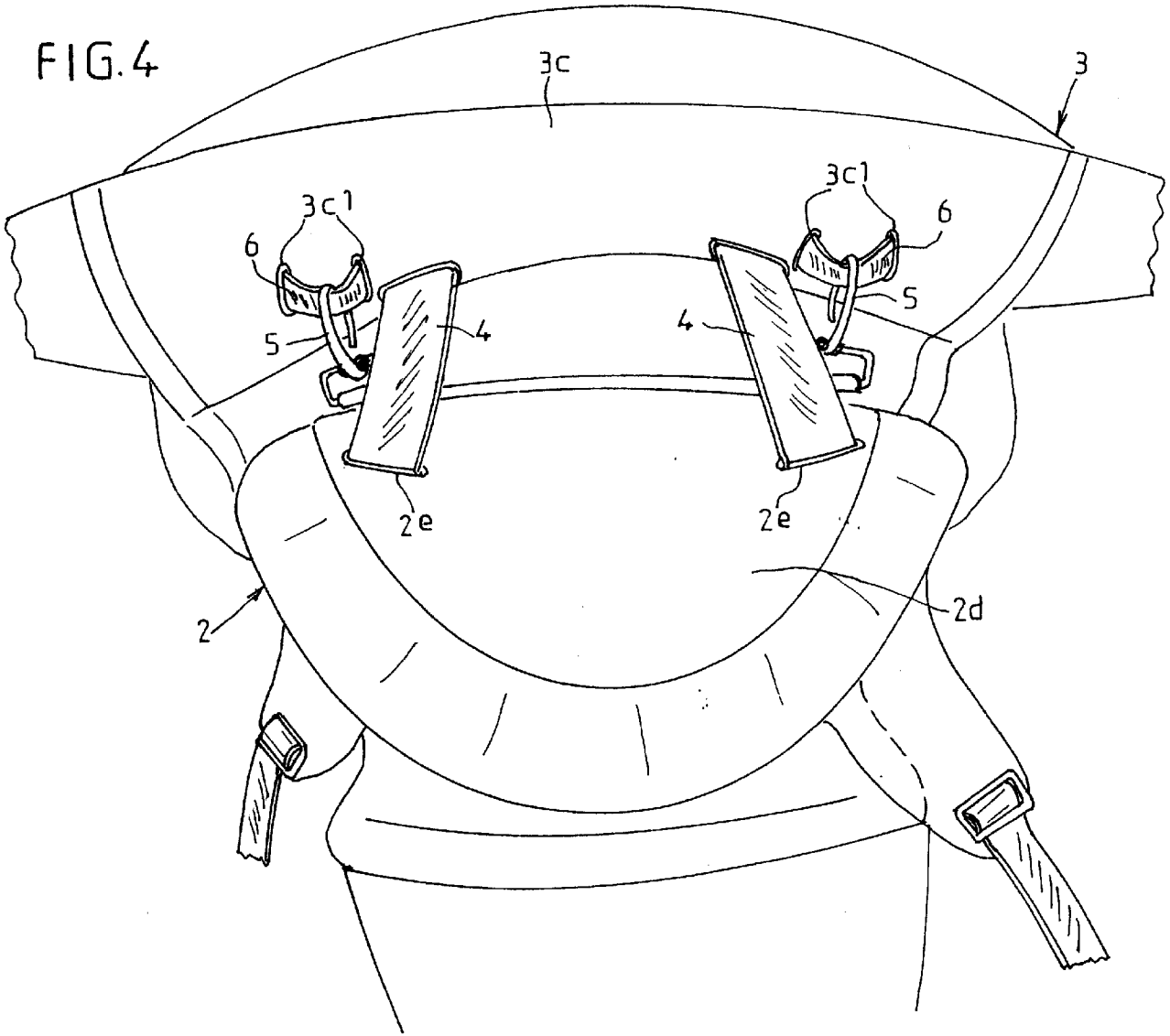
FIG. 4 is a view from above of the modular child carrier showing the connection between the front-mounted child carrier and the framework of the back-mounted child carrier.
Figure 5:
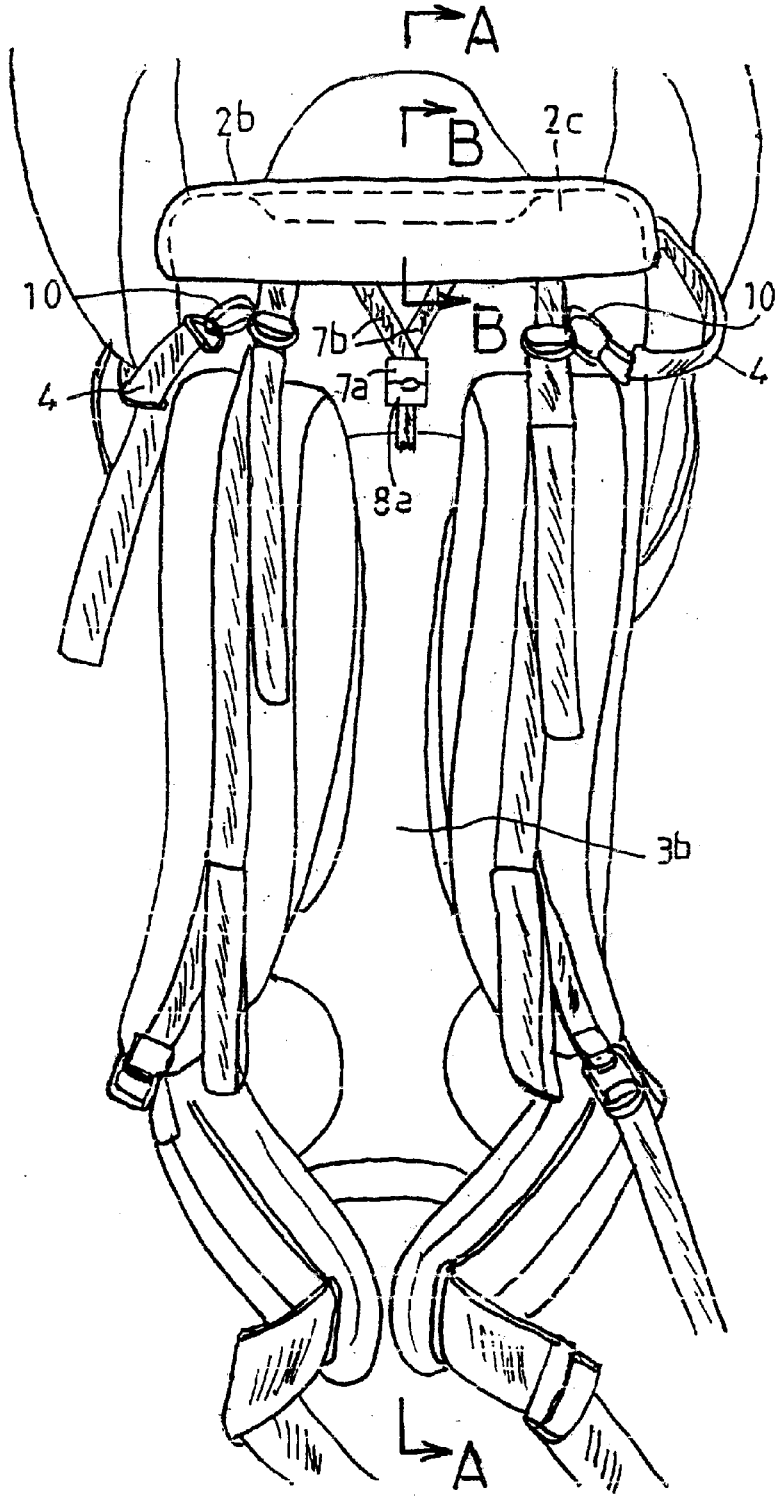
FIG. 5 is a front view of the modular child carrier showing in particular the connection between the front-mounted child carrier and the back-mounted child carrier.
Figure 6:
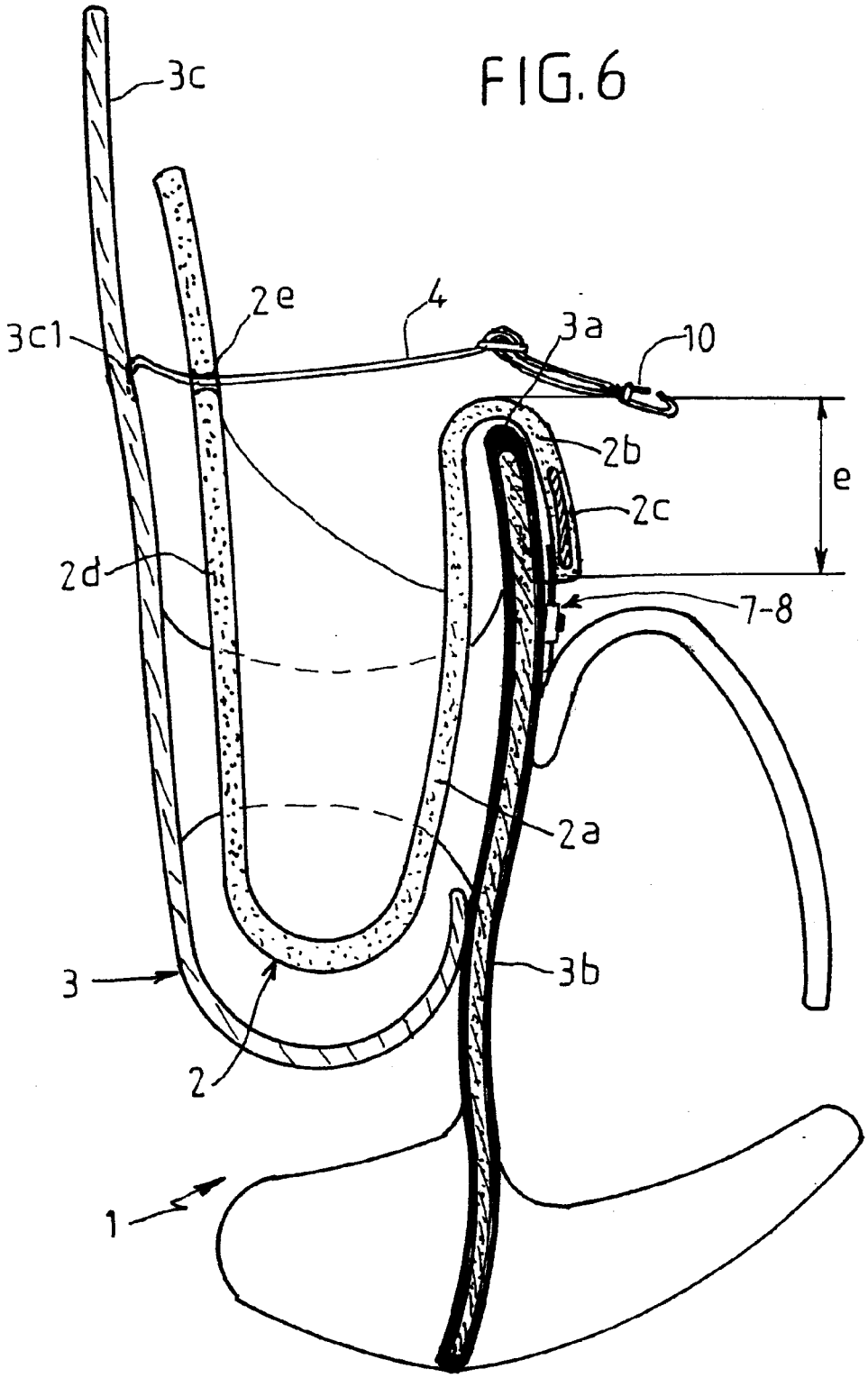
FIG. 6 is a side view in section on the line A—A of FIG. 5, showing the connection and positioning of the front-mounted child carrier on the back-mounted child carrier.

To make the subject of the invention more concrete, it is now described in a nonlimiting way illustrated in the figures of the drawings.

The modular child carrier according to the invention is referenced in its entirety as (1). It includes a front-mounted child carrier (2) and a back-mounted child carrier (3).

These front-mounted and back-mounted child carriers are designed in any known way with harnesses, belts, shoulder straps, straps and other components which do not form part of the present invention. They are illustrated in the drawings as an aide-mémoire but are not described specifically in the remainder of the description.

According to the invention, the back-mounted child carrier (3) is designed to allow the temporary insertion and positioning of the front-mounted child carrier (2) when the wearer needs to combine these with a view to transporting a child of a very tender age on excursions, walks and the like. For this purpose, the front-mounted child carrier and the back-mounted child carrier are designed with connecting and suspension means allowing said front-mounted child carrier to be positioned in complete safety inside the volume of the back-mounted child carrier.

To this end, in an advantageous embodiment of the invention, the front part (2*a*) of the front-mounted child carrier (2) is designed at its end and over its length with a cap shape (2*b*) which can be positioned over the corresponding top part (3*a*) of the framework (3*b*) of the back-mounted child carrier (3). More specifically, said cap (2*b*) has a certain depth (e) preferably with a stiffening means (2*c*) such as a plate or the like.

Furthermore, the framework (3*b*) is rigid at its upper front end, and can flip into the abovementioned cap to make a temporary connection. Said framework is covered in the conventional way with a protective textile covering.

This specific positioning makes it possible for the front-mounted child carrier to be suspended firmly in its front part with the load and therefore the weight of the child being well distributed.

The dorsal rear part (2*d*) of the front-mounted child carrier (2) is designed on the one hand with slots (2*e*) allowing the passage of associated securing straps (4) attached in the regions (3*c*1) from the backrest part (3*c*) of the back-mounted child carrier (3). On the other hand, the aforementioned rear part (2*d*) of the front-mounted child carrier is designed with connecting means (5) of the hook, shackle or similar type which can be fastened and fixed to loops (6) arranged on the rear part of the backrest of the back-mounted child carrier.

There is also provision for the cap of the front-mounted child carrier to have a complementary means (7) of connection and attachment to a means (8) arranged on the front part of the rigid framework of the back-mounted child carrier. More specifically, the means (7) is a female or male fastener (7*a*) arranged on a strap (7*b*), while the means (8) is a complementary male or female fastener (8*a*).

Thus, according to the invention, and in this embodiment, the front-mounted child carrier is perfectly positioned and held on the framework of the back-mounted child carrier both in the assembly of the cap over said framework and via the various aforementioned complementary connecting and holding means.

In addition, the straps (4) which pass through the slots (2*e*) made on the front-mounted child carrier continue, passing over the shoulders of the child, and, via end-mounted fasteners (10) are coupled to fastening or fixing means that there are on the back-mounted child carrier. Furthermore, the stiffening means (2*c*) and the upper part of the framework may be shaped with a recess (2*f*) (3*d*) to allow the child to rest its head more readily by way of a chin rest.

In this particular embodiment, the child is perfectly secured.

As an alternative, the front-mounted child carrier can be positioned on the framework of the back-mounted child carrier in the way depicted in FIG. 8 of the drawings. In this case, the front part of the front-mounted child carrier has no cap and fits snugly onto and is secured to, using touch-and-close means (12), the face of the rigid framework opposite it, while strapping means (11) of the touch-and-close strap (11*a*) type hold the assembly together.

As an alternative, the front-mounted child carrier can be suspended from the back-mounted child carrier by connecting and holding means.

The advantages of the invention are clear; the novel design of the modular child carrier, and the ease of adjustment of the front-mounted child carrier are emphasized.

What is claimed is:

1. A modular child carrier comprising a back-mounted child carrier designed to accommodate internally a front-mounted child carrier, the two child carriers being arranged with linking and temporarily securing means allowing at least one of the front-mounted child carrier to be detached and used independently, and the front-mounted child carrier to be incorporated into the back-mounted child carrier so that a child of a very tender age can be carried.

2. The child carrier as claimed in claim 1, wherein the front-mounted child carrier is fitted on its front face with a cap shape having stiffening means and capable of being adjusted and positioned over an upper part of a front face of a framework of the back-mounted child carrier.

3. The child carrier as claimed in claim 2, wherein the stiffening means and the upper part of the framework can be shaped with a recess to allow the child to rest its head more readily by way of a chin rest.

4. The child carrier as claimed in claim 2, wherein the cap of the front-mounted child carrier has a complementary means of connection and of securing to a means arranged on the upper part of the framework of the back-mounted child carrier.

5. The child carrier as claimed in claim 4, wherein the first means is a female or male fastener arranged on a strap, while the second means is a complementary male or female fastener.

6. The child carrier as claimed in claim 1, wherein a dorsal rear part of the front-mounted child carrier is configured with slots allowing the passage of associated securing straps fixed in the regions from a backrest part of the back-mounted child carrier, and wherein a rear part of the front-mounted child carrier is configured with connecting means which can be fastened and secured to loops arranged on a rear part of the backrest part of the back-mounted child carrier.

7. The child carrier as claimed in claim 6, wherein the straps that pass through the slots made in the front-mounted child carrier continue, passing over the shoulders of the child and, via end-mounted fastening means, can be coupled to fastening or securing means on the back-mounted child carrier.

8. The child carrier as claimed in claim 1, wherein the front-mounted child carrier is positioned on a framework of the back-mounted child carrier with a front part of the front-mounted child carrier fitting snugly onto and secured to, using touch-and-close means, a face of a rigid framework opposite it, while strapping means of the touch-and-close strap type hold the assembly together.

9. The child carrier as claimed in claim 1, wherein the front-mounted child carrier is suspended from the back-mounted child carrier by connecting and holding means.

* * * * *